United States Patent [19]

Kluger

[11] 4,416,534

[45] Nov. 22, 1983

[54] APPARATUS AND METHOD FOR REGISTERING COPY SHEETS IN A VARIABLE PITCH REPRODUCTION MACHINE

[75] Inventor: Jacob N. Kluger, Rochester, N.Y.

[73] Assignee: Xerox Corporation, Stamford, Conn.

[21] Appl. No.: 318,300

[22] Filed: Nov. 5, 1981

[51] Int. Cl.[3] ..... G03G 15/00

[52] U.S. Cl. ..... 355/14 SH; 355/3 SH

[58] Field of Search ..... 355/14 SH, 3 SH, 3 TR, 355/3 TE, 3 BE, 16, 14 C, 48–51, 77; 271/270

[56] References Cited

U.S. PATENT DOCUMENTS

| | | | |
|---|---|---|---|
| 3,834,805 | 9/1974 | Griffin | 355/8 |
| 3,888,579 | 6/1975 | Rodek et al. | 355/14 |
| 4,000,943 | 1/1977 | Bar-on | 355/14 SH |
| 4,009,957 | 3/1977 | Suzuki et al. | 355/14 SH |
| 4,025,178 | 5/1977 | Yokozawa | 355/14 SH |
| 4,025,186 | 5/1977 | Hunt et al. | 355/16 X |
| 4,026,647 | 5/1977 | Kanno et al. | 355/3 SH |
| 4,110,033 | 8/1978 | Aphey | 355/14 |
| 4,165,170 | 8/1979 | Donohue | 355/14 |
| 4,170,791 | 10/1979 | Daughton et al. | 355/14 X |
| 4,192,609 | 3/1980 | Tani et al. | 355/77 |
| 4,203,663 | 5/1980 | Ogura et al. | 355/14 C |
| 4,214,833 | 7/1980 | Kono | 355/14 |
| 4,299,473 | 11/1981 | Endo | 355/14 SH |

OTHER PUBLICATIONS

Publ. "Digital Position Control Systems", author: Jacob Tal, presented at the Incremental Motion Symposium during Apr. 1979.

Publ. "Speed Control by Phase-Locked Servo Systems-New Possibilities & Limitations", author: Jacob Tal, presented at the above symposium during Apr. 1979.

Publ. "Eliminating False Lock in Phase-Locked Servo Systems", author: W. K. Whitaker & J. Tal; presented at the above mentioned symposium in Apr. 1979.

Publ. "Solid State Control for DC Motors Provides Variable Speed with Synchronous-Motor Performance", by E. K. Howell & presented at the IEEE--Trans., vol. IGA-2, No. 2, Mar.-Apr. 1966, pp. 132–136.

*Primary Examiner*—Richard L. Moses

[57] ABSTRACT

In xerography, registration method and apparatus for a variable pitch copier. The invention has particular utility in achieving a speed and position match between a copy sheet and an image on a photoconductor as the copy sheet approaches an image transfer station. According to the invention the speed and position of both image and copy sheet are monitored and updated by a programmed microprocessor. Controlled accelerations and brakings of a copy sheet drive motor under microprocessor control first achieve registration and then maintain that registration as the image transfer occurs. The disclosed registration automatically adjusts for variable spacings between successive images about the periphery of the photoconductor to accommodate various image sizes.

9 Claims, 13 Drawing Figures

62
60
54
E
58
52
56
D
50
F
64
18
22
16
A
28
30
32
34
36
B
14
10
38
C
24
20
B
42
48
71
70
46

128
154
124a
124b
124c
124d
TO CONTROLLER
1
2
4
6
8
19
20
18
16
14
12
VCC
+12
680Ω
470Ω
.047μ
MACHINE CLOCK (CLK)
PHOTOCONDUCTOR SENSOR (A)
TRANSPORT FINGER (B)
TRANSPORT CLOCK (TACH)

162
+24 V.
TI P 125
Q1
24
IN4002
Q2
TI P 125
164
166
+5
100 Ω
+5
100 Ω
126 a
126 b
FROM CONTROLLER 122

APPARATUS AND METHOD FOR REGISTERING COPY SHEETS IN A VARIABLE PITCH REPRODUCTION MACHINE

BACKGROUND OF THE INVENTION

1. Field of the Invention

The invention relates to xerographic registration apparatus in general and in particular relates to registration method and apparatus for use in conjunction with a variable or multiple pitch copying machine.

2. Prior Art

In xerographic copying, a first step in the generation of a copy is the creation of a latent electrostatic image on a photoconductive material corresponding to light images of a document original. The latent image is then developed with toner material to render the latent image visible. This visible image is next transferred to a copy sheet at a transfer station and fixed to the copy sheet at a fusing station. It is of obvious importance that the visible toner image is in registration with the copy sheet at the transfer station so that the entire developed image is transferred to the copy sheet. It is also of equal importance that the image speed on the moving photoreceptor match the speed of the moving copy sheet to avoid a blurring of the imaging during transfer.

As the art of xerography has matured, different copier architectures have evolved. Certain high speed commercial xerographic copiers include belt or drum type photoconductors having image developing surface areas capable of holding multiple latent images about their periphery. The number of images which can be fit about the photoconductor depends upon the dimensions of both the photoconductor and the images supported thereon. The amount of space each image occupies including inter-image gaps is known as the copier pitch.

In many commercial copiers, the spacing or pitch occupied by images about the photoconductor is fixed. Since the typical document is imaged with its width dimension along the length of the photoconductor, so long as all documents have substantially the same width the pitch or spacing is constant. For a fixed pitch system the task of registering the copy sheet with the developed powder image is simplified. The photoconductor is driven at a constant rate so that the developed images approach the transfer station at a constant rate. If the copy sheets are driven to the transfer station at the same rate and the spacing between individual copy sheets is chosen to be equal to the photoconductor pitch once an initial synchronization between sheet and image is achieved only minor changes in the copy sheet drive speed are needed to maintain registration.

So-called multiple or variable pitch copier systems are also known. These systems copy document originals of differing widths so that the image spacing about the photoconductor periphery changes with document size. A photoconductor large enough to accomodate five images for one size document might only accomodate four document widths for a wider document. If the copier pitch changes, the timing of the copy sheet arrival at the transfer station must also change if a proper image transfer is to occur.

The variable pitch of a copier also affects the way the document is imaged onto the photoreceptor. In automatic high speed copying machines, document originals are fed automatically to a station for imaging on the photoreceptor. In certain instances it is important that the image of each sheet appears at a particular position about the multiple pitch photoreceptor.

The system disclosed in U.S. Pat. No. 3,888,579 to Rodek et al maintains document feed registration with respect to the photoreceptor by controllably accelerating or decelerating the document sheet by an appropriate amount, depending upon whether the sheet is lagging or leading its appropiate pitch frame location on the photoreceptor. The system employs a photodetector which identifies the passage of the leading edge of a document sheet at a registration point in the sheet path of travel. A comparator circuit utilizes this information to determine whether the document sheet is properly registered. If a misregistration is sensed, a correction is instituted through control of a drive stepping motor which either speeds up or slows down a drive roll by an amount required to place the documents in appropriate relation to the pitch frame on the photoreceptor.

While the '579 patent is limited in its disclosure to a mechanism for registering an original document to be copied, similar control techniques have application in copy sheet registration.

Applicability of document feed registration techniques for both original and copy sheet feeders has been recognized and in particular U.S. Pat. No. 4,170,791 to Daughton et al recognizes at column 10 that copy sheets can be either speeded up or slowed down to ensure that the sheet moves into contact with the photoreceptor drum at an appropriate speed and location.

The Rodek et al system which employs the stepping motor to either speed up or slow down the document feed apparatus has no feedback checking mechanism to insure that the steps taken to achieve registration are actually functioning properly. Wear in the system components and time delays in registration signal transmission can introduce sources of misregistration.

Proposals have been made to register documents using a servo drive system in conjunction with a feedback control technique whereby speed registration between a document and an image is continuously updated by known phase lock loop motor control techniques. The phase lock loop speed control proposals work well in a fixed pitch system, but cannot provide the speed and position registration needed in a variable pitch copier.

From the above it should be appreciated that while document feed registrations are known, and more particularly document feed registrations for use in conjunction with multiple or variable pitch copiers are known, prior art systems for achieving registration for such copiers have experienced difficulties in achieving accurate document feed registration. Prior art registration techniques have either been inaccurate or became inaccurate with use of the copier. Regardless of the cause, such misregistration is undesirable especially if good quality copies are to be obtained.

SUMMARY OF THE INVENTION

The present invention is particularly suited for use with a multiple pitch copier and includes method and apparatus for achieving and maintaining both position and velocity registration between a moving sheet of paper (either original or copy sheet) and a moving photoreceptor belt or drum. A number of system status inputs are continually monitored by a registration controller which responds to these inputs by controllably actuating a drive motor coupled to a sheet drive mechanism. By monitoring and responding to these inputs, it is possible for position registration between photoreceptor and sheet to be rapidly achieved, and once achieved to be maintained. The monitoring and control functions are preferably accomplished through utilization of a programmable unit and according to a preferred embodiment a programmable microprocessor. Since the microprocessor is capable of monitoring and updating the system status inputs very rapidly, the paper drive synchronization is achieved and maintained more effectively than the prior art multiple pitch registration schemes.

In the following discussion, it should be appreciated that although a copy sheet movement mechanism is described and its synchronization discussed, the particular invention has utility for movement of original documents to an exposure station. Thus, the term "document original" could be substituted for the term "copy sheet" without departing from the scope of the invention.

In designing multiple pitch copiers, it is advantageous to design the sheet feeder with the same pitch or drive finger spacing as one of the multiple photoreceptor pitch dimensions. When this design is chosen, prior art speed control techniques can be used to register the copy sheet and the latent image on the photoreceptor. Since it is desirable to maintain photoreceptor belt speed constant, when the photoreceptor pitch or spacing does not match the registration pitch, adjustments are made in the speed of the sheet feeder rather than the photoreceptor.

According to the invention, apparatus is provided for monitoring the movement of a sheet toward the image transfer station. In response to this monitoring a control unit initiates changes in sheet speed to avoid position and/or speed mis-registration between the sheet and an image formed by the variable pitch copier. The control unit is operatively coupled to a drive motor for varying the speed of sheet movement to bring the sheet into registration. As both position and speed registration are achieved, the control unit continues to monitor movement of the copier and sheet to assure that the conformity in registration is maintained as the sheet approaches the photoreceptor.

The registration is accomplished digitally. The high speed microprocessor cycle time enables the status of the registration to be continually updated and the accuracy of the registration maintained. The use of digital status inputs avoids the necessity of converters in the feedback portion of the control loop.

From the above, it should be apparent that one object of the present invention is to provide substantial position and speed registration between a multiple pitch photoreceptor belt and a drive mechanism for delivering copy sheets to a transfer station in the copier. To achieve this object, a monitoring technique updates registration control as the copy sheet travels to the photoreceptor belt. Other objects and features of the present invention will become better understood when a preferred embodiment of the invention is discussed in conjunction with the accompanying drawings.

DESCRIPTION OF A PREFERRED EMBODIMENT

Figure 1:
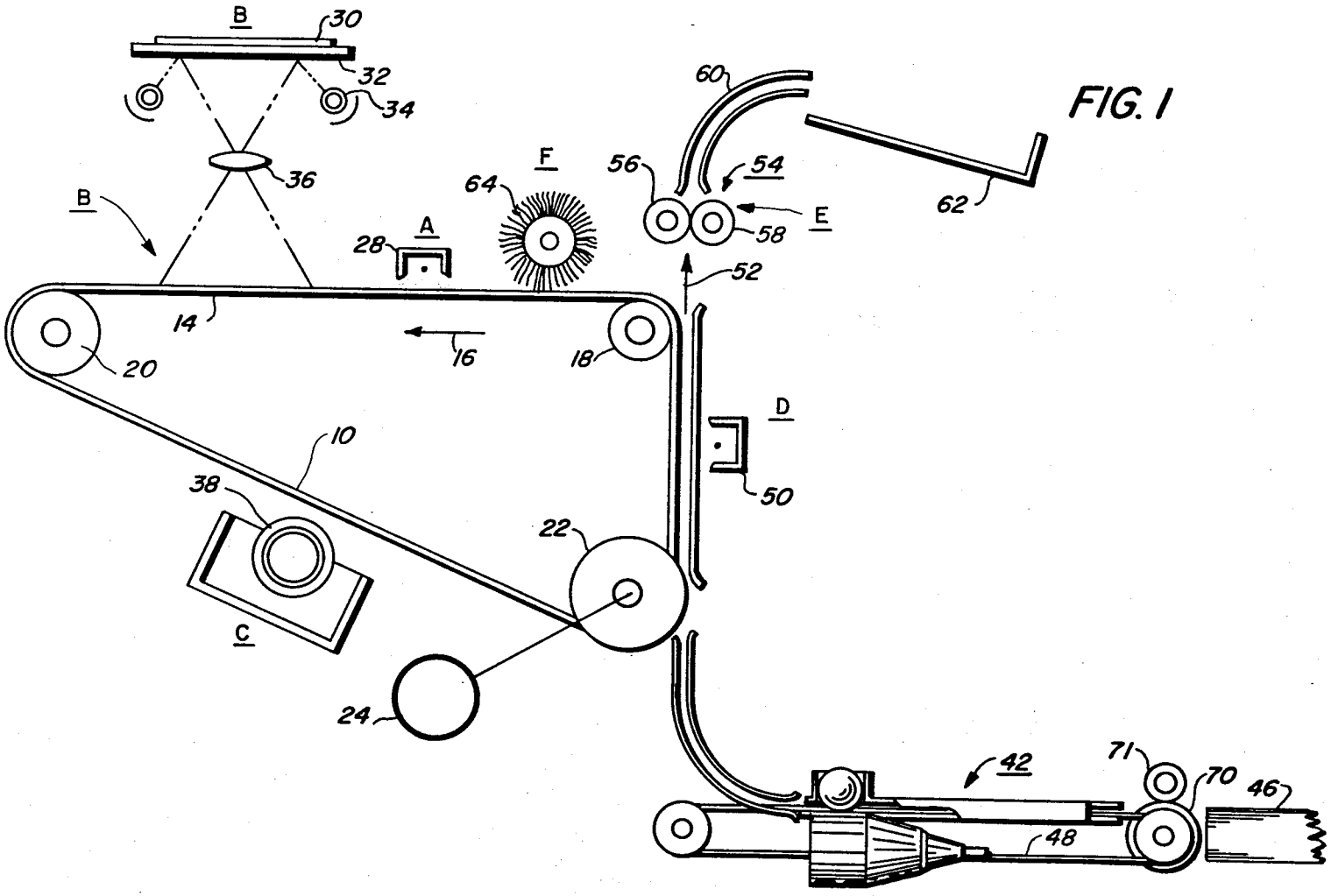
FIG. 1 schematically represents an electrophotographic printing machine or copier.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the variable pitch registration apparatus of the present invention.

As shown in FIG. 1, the electrophotographic printing machine employs a belt 10 having a photoconductive surface deposited on a conductive substrate. Preferably, the photoconductive surface is made from a selenium alloy with the conductive substrate made from an aluminum alloy. Belt 10 moves in the direction of arrow 16 to advance successive portions of photoconductive surface sequentially through the various processing stations disposed about the path of movement thereof. Belt 10 is entrained around a stripper roller 18, a tension roller 20, and a drive roller 22.

Figure 2:
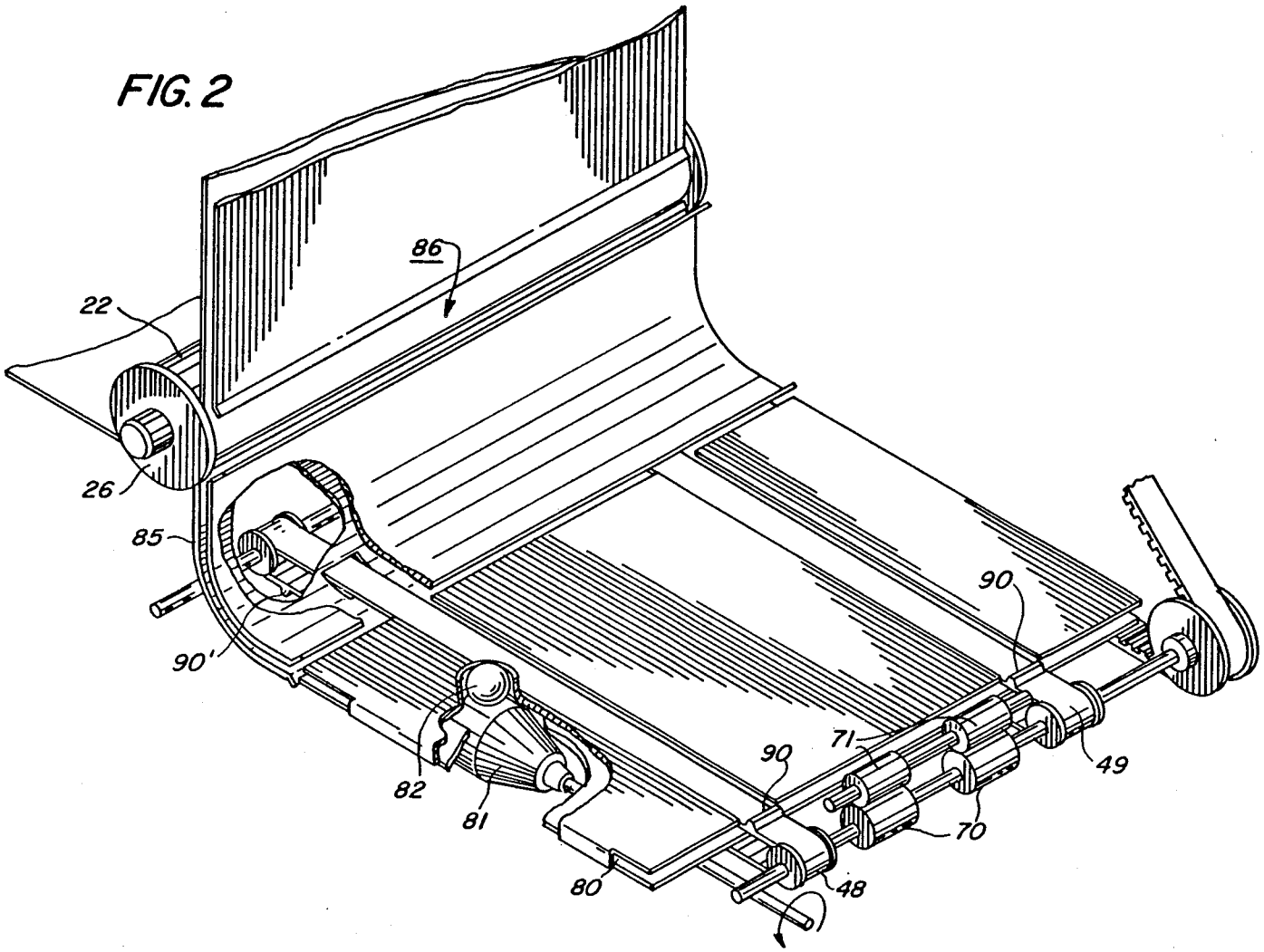
FIG. 2 is a perspective view of a copy sheet registration device used for driving successive copy sheets to an image transfer station.

Drive roller 22 is mounted rotatably in engagement with belt 10. Roller 22 is coupled to a suitable means such as drive motor 24 through a belt drive. The drive motor 24 rotates roller 22 to advance belt 10 in the direction of arrow 16. Drive roller 22 includes a pair of opposed spaced flanges or edge guides 26 (FIG. 2). Edge guides 26 are mounted on opposite ends of drive roller 22 defining a space therebetween which determines the desired predetermined path of movement for belt 10. Edge guide 26 extends in an upwardly direction from the surface of roller 22. Preferably, edge guides 26 are circular members or flanges.

Belt 10 is maintained in tension by a pair of springs (not shown), resiliently urging tension roller 22 against belt 10 with the desired spring force. Both stripping roller 18 and tension roller 20 are mounted rotatably. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges the photoconductor surface of the belt 10 to a relatively high, substantially uniform potential. A suitable corona generating device is described in U.S. Pat. No. 2,836,725 issued to Vyverberg in 1958.

Next, the charged portion of the belt's photoconductive surface is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush developer roller 38 advances a developer mix into contact with the electrostatic latent image. The latent image attracts the toner particles from the carrier granules forming a toner power image on the photoconductive surface of the belt 10.

Belt 10 then advances the toner powder image to transfer station D. At transfer station D, a sheet of support material is moved into contact with the toner powder image. The sheet of support material is advanced toward transfer station D by a registration device 42. Preferably, the registration device 42 includes pinch rolls 70 and 71 which rotate so as to advance the uppermost sheet feed from stack 46 into transport belts 48 and 49. The transport belts direct the advancing sheet of support material into contact with the photoconductive surface of belt 10 in a timed sequence so that the toner powder image developed thereon synchronously contacts the advancing sheet of support material at transfer station D. More particularly, according to the present invention the synchronization is achieved regardless of the pitch or image spacing on the photoreceptor belt 10.

Transfer station D includes a corona generating device 50 which sprays ions onto the backside of a sheet passing through the station. This attracts the toner powder image from the photoconductive surface to the sheet and provides a normal force which causes the photoconductive surface to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

After the sheet support material is separated from the photoconductive surface of belt 10, some residual particles typically remain adhering thereto. These residual particles are removed from photoconductive surface at cleaning station F. Cleaning station F includes a rotatably mounted brush 64 in contact with the photoconductive surface. The particles are cleaned from photoconductive surface by the rotation of brush 64 in contact therewith. Subsequent to cleaning, a discharge lamp (not shown) floods photoconductive surface with light to dissipate any residual electrostatic charge remaining thereon prior to the charging thereof for the next successive image cycle.

FIG. 2 shows the registration device 42. A copy sheet enters the registration device 42 driven by opposing pairs of pinch rolls 70 and 71. When the copy sheet trail edge passes through the nip formed between pinch rolls 70 and 71, it is driven toward the photoreceptor belt 10 by fingers 90, 90' attached or molded into belts 48 and 49. While two fingers 90, 90' are shown on belts 48 and 49, it should be understood that one finger on each belt will work as will three or more on each belt. A baffle 85 consisting of parallel surfaces approximately 3 mm apart guides the substrate into the xerographic transfer zone 86. The tacking forces of transfer slightly overdrive the substrate pulling it away and thus uncoupling it from the forward drive of the fingers 90.

A side registration technique for aligning the copy sheet with the photoreceptor is disclosed in copending U.S. application Ser. No. 81,413 entitled "Trail Edge Copy Registration" filed Oct. 3, 1979. As disclosed in that application the copy sheet is driven sideways and registered against side registration edge or stop 80 by co-action between a rotating scuffer member 81 and a normal force ball 82. Once the copy sheet is side registered it stops and waits for finger 90 to come into contact with its trail edge and supply a forward transport force.

Figure 3:
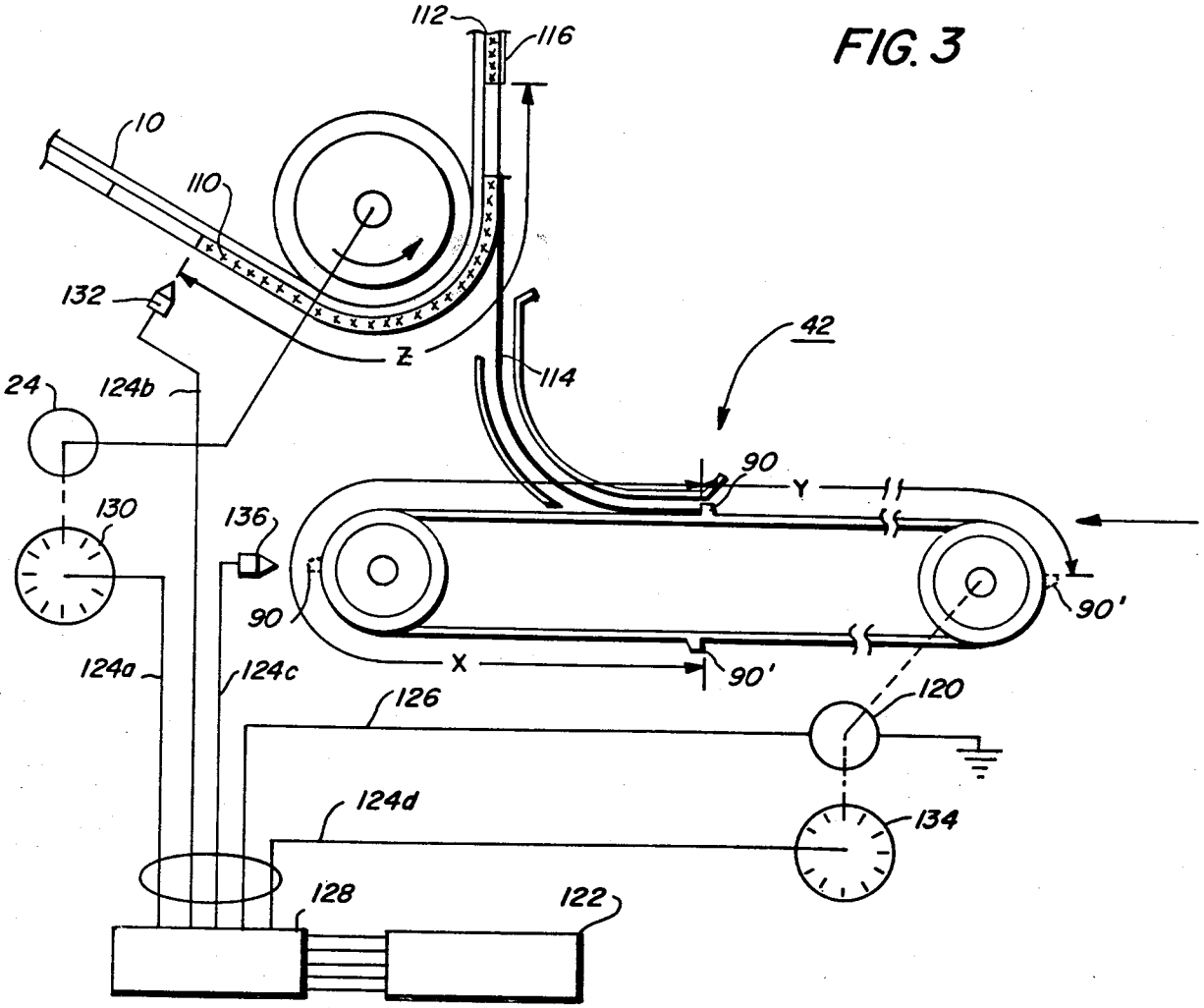
FIG. 3 is a schematic elevation view of the FIG. 2 registration device showing a copy sheet moving to the transfer station.

FIG. 3 schematically illustrates a portion of the electrophotographic printing machine shown in FIG. 1 and in particular illustrates the belt 10 having images 110, 112 developed on the photoconductive surface. Other images of the same width dimension are spaced about the periphery of the photoreceptor in a similar spaced relationship. The registration device 42 is seen to be driving a copy sheet 114 into contact with the photoreceptor so that the image 110 is transferred to that sheet 114. A previously registered sheet 116 is seen to be affixed to the belt 10 in proper registration with the second image 112 shown in FIG. 3.

It should be apparent to those skilled in the art that proper copy sheet registration with photoreceptor images is simplified if the spacing z between corresponding points on successive images is equal to the spacing x between successive fingers 90, 90' on the registration device 42. If such a relationship exits, the linear speed of the fingers 90, 90' can be made to match the speed of the image on the photoreceptor and once an initial position registration between image and copy sheet is achieved proper registration will be maintained so long as the two speeds remain equal. In a single pitch copier, the registration device 42 can be designed to have the same spacing x between fingers as the photoreceptor images and copy sheet registration can be maintained using techniques known in the art.

For a multiple pitch copier, i.e., a coper wherein the distance z between corresponding points on successive image changes depending on the size of the document sheet 30, such a registration technique is not possible. For the multi-pitch copier, the distance z (FIG. 3) is not equal to the distance x for at least one mode of copier operation. In the system illustrated in FIG. 3, the distance z is less than the spacing x between registration fingers 90, 90'. It should be appreciated that typically in a multi-pitch copier, a second photoreceptor spacing is used where the spacing z is equal to the distance x so that the copy sheet and photoconductor are more easily registered. Although the illustrated embodiment depicts the situation where z is less than x, it should be appreciated that the disclosed techniques comprising the present invention can be used to achieve copy sheet registration in an instance where the pitch distance z is greater than the spacing x between registration fingers 90.

In the FIG. 3 illustration, the linear speed of the registration finger 90 should equal the linear speed of the image 110 at the point of sheet hand-off. As seen, position registration between copy sheet and images has already been achieved and so long as the speed of the finger 90 matches the speed of rotation of the photoreceptor, a properly aligned image should appear on the copy sheet 114 after the image has been transferred. At the illustrated point in time, a second registration finger 90' on the bottom surface of the registration device 42 moves in a linear direction opposite to the first registration finger 90. After the copy sheet 114 has been completely transferred to the photoreceptor belt, the two registration fingers 90, 90' will have been positioned so that the second registration 90' is now in position to advance a subsequent copy sheet to the photoreceptor belt (see phantom position FIG. 3). Since the separation x between registration fingers 90, 90' is greater than the separation z between corresponding locations of the photoreceptor images, unless the registration device 42 is temporarily accelerated, the next copy sheet will be mis-registered when it contacts the photoreceptor belt. In particular, its leading edge will contact the photoreceptor belt after the leading edge of the next image to be copied has passed that point of contact. It should be apparent, therefore, that the registration mechanism 42 must be accelerated to achieve a proper registration between belt 10 and copy sheet. In particular, the mechanism 42 has a distance y between the point at which the finger 90' contacts the sheet and the point at which the copy sheet contacts the photoreceptor in which to make adjustments in both speed and position to insure a proper registration and therefore a properly positioned and non-blurred image is transferred.

In the embodiment illustrated, the drive motor 24 rotates at a constant speed which causes the images on the photoreceptor belt 10 to traverse past the registration device 42 at a constant speed. The registration device 42 is driven by a registration motor 120 which according to the preferred embodiment of the invention comprises direct current motor. Controlled acceleration and deceleration of this motor 120 allows the registration fingers 90, 90' to be properly registered in relation to the photoreceptor images before the copy sheet 114 contacts the photoreceptor belt. Controlled acceleration and deceleration of the motor 120 is achieved under control of a preprogrammed microprocessor 122. The microprocessor 122 responds to a series of inputs 12*a–d* which transmit signals indicative of the operating status of the system and generates an output 126 to control acceleration and deceleration of the motor 120. The inputs 124*a–d* and output 126 are transmitted through an interface 128 to be described.

The inputs 124*a–d* are indicative of photoreceptor speed, image position, registration device speed, and registration finger position. With this information, the microprocessor 122 can properly initialize motor acceleration and de-acceleration to initially register the copy sheet and then monitor continued registration between photoreceptor and registration device. The photoreceptor speed is monitored from signals from an optical encoder 130 which monitors the speed of rotation of the drive motor 24. The position of images on the photoreceptor is monitored by a sensor 132 which senses the passage of equally spaced marks positioned about the periphery of the photoreceptor belt. These marks are placed xerographically at a specific location on the photoreceptor width at the time of image formation on the photoreceptor. The spacing between marks corresponds to the image pitch and will vary depending on the pitch mode the copier is operating in. A second encoder 134 monitors registration device speed by monitoring the rotation of the motor 120 and finally, a second sensor 136 monitors the position of the registration fingers 90, 90' affixed to the two belts 48, 49, respectively.

The exemplary circuitry for applying controlled accelerations and decelerations to the registration fingers 90, 90' comprises an Intel 8085 microprocessor 122. The 8085 microprocessor and its support hardware comprises an input port which monitors the inputs 124*a–d*. The microprocessor 122 is coupled to both read only and read/write memory units which cause the microprocessor to perform a registration routine to be described. The coupling between microprocessor and memory units is accomplished by a sixteen line address bus and an eight line data bus. A detailed description of the 8085 may be obtained in the Intel 8085 user's manual entitled "MCS-85 (Registered Trademark) User's Manual" available from the Intel Corporation, 3065 Bowers Avenue, Santa Clara, California 95051. That manual is incorporated in the present application by reference. Typically, the microprocessor 122 comprises one of a number of processors in the printing machine which monitor and control printing.

Figure 4:
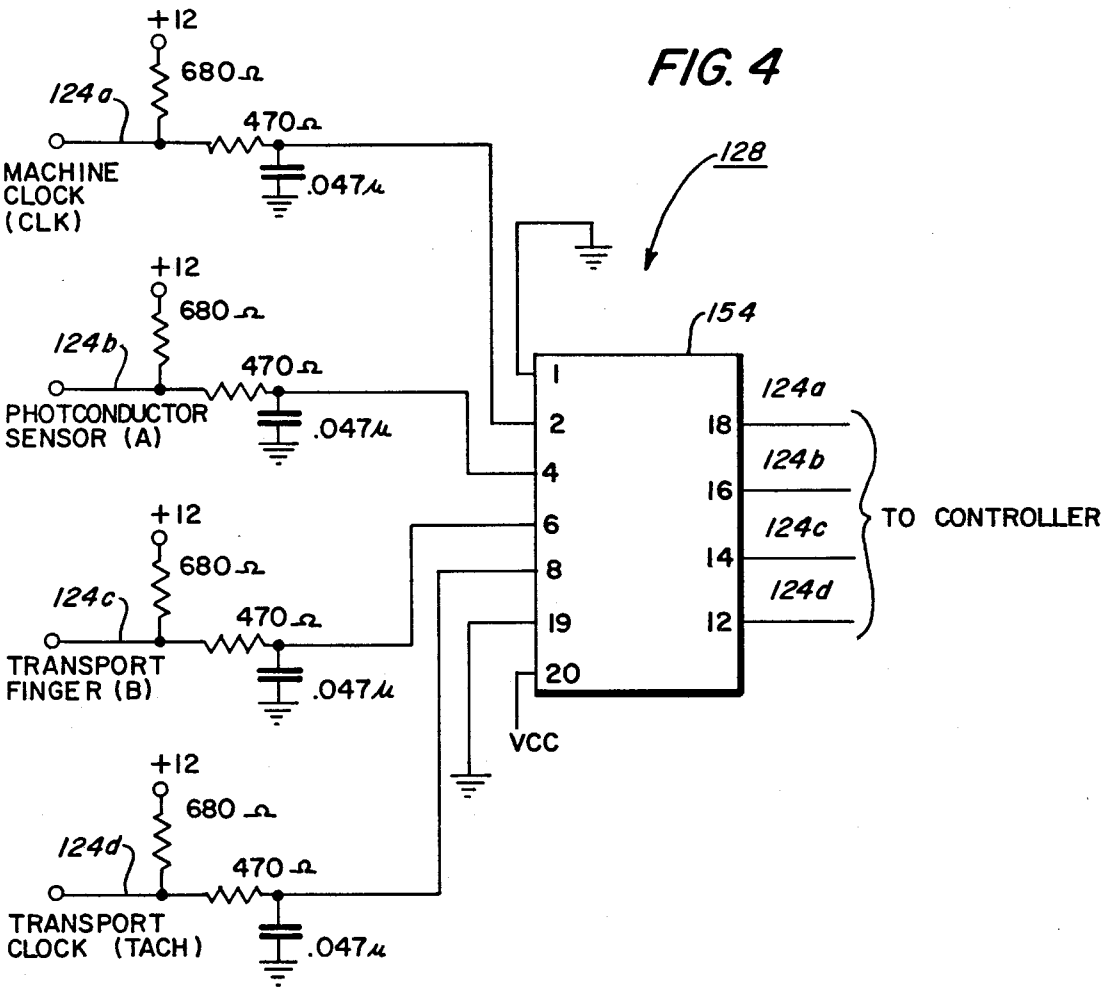
FIG. 4 is a schematic showing a portion of an interface between sensors monitoring the functioning of the printing machine and a microprocessor for controlling movement of the registration device.

The plurality of sensors 130, 132, 134, 136 generate signals which serve as inputs to the microprocessor 122. Referring to FIG. 4, each input 124*a–d* goes low in response to a certain event during copier operation. The input 124*a* coupled to the machine clock periodically transmits a "low" signal in response to the drive motor 24 rotation which causes the photoreceptor to move in relation to the registration mechanism 42. The second input 124*b* goes low in response to the sensing of the presence of one of the markings on the photoreceptor. This indication can be related to the position of the image on the photoreceptor and, therefore, this input 124*b* provides an indication of the position of the photoreceptor images in relation to sensor 132. A third input 124*c* is coupled to the sensor 136 and generates a low signal whenever the sensor 136 senses one of the pitch registration fingers 90, 90'. Inputs on this line, therefore, indicate the start of movement position for the copy sheet. Finally, the fourth input 124*d* is coupled to the encoder 134 which monitors the transport motor speed. Repetitive low signals are generated along this input 124*d* in response to rotation of the motor 120 and therefore this signal relates to registration speed.

The inputs 124*a–d* from the sensors are connected to a signal buffer 154 which in the preferred embodiment comprises a LS241 model buffer obtainable from many sources one of which is Texas Instruments Inc. of Dallas, Texas. Pins 1 and 19 of the buffer are grounded so that the input on pins 2, 4, 6, 8 appear as an output on pins 18, 16, 14 and 12, respectively. Since only a state inversion (high to low and low to high) occurs within the buffer, the outputs at these pins have also been labeled 124*a–d*.

The signals 124*a–d* are directly connected to a microprocessor input port. Due to the state inversion, the occurrence of a machine clock (CLK), or transport clock (TACH) signal causes the inputs 124*a*, 124*d* to go high. Similarly, the sensing of either a tranport finger 90, 90′ (Event B) or a mark on the photoconductor (Event A) causes the inputs 124*b*, 124*c* to go high.

Figure 5:
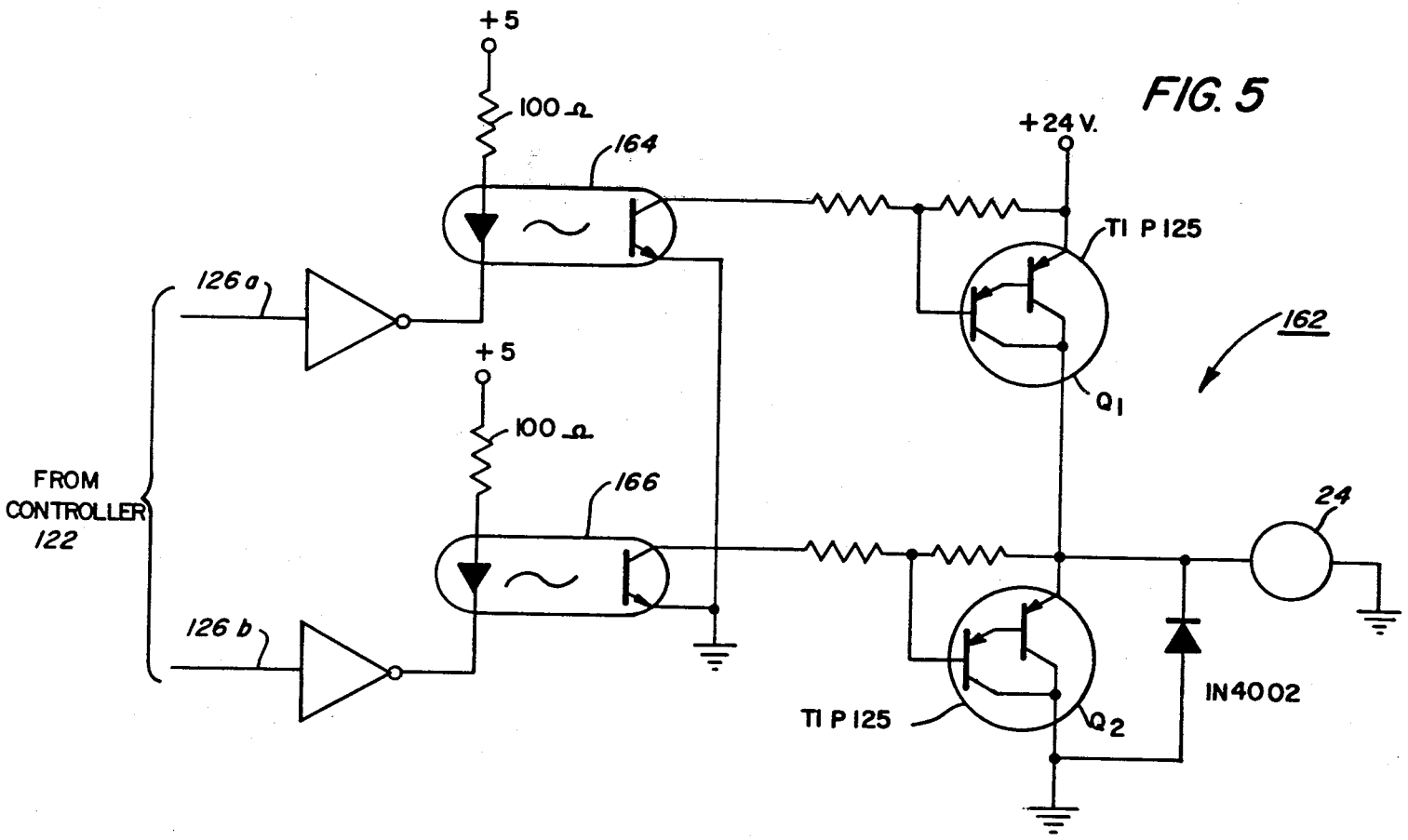
FIG. 5 shows the interface between the microprocessor and a motor which drives the registration device.

The output portion of the microprocessor interface 128 is illustrated in FIG. 5. The controller 122 is electrically isolated from a motor drive circuit 162 by two electro-optic isolates 164, 166. The motor drive 162 comprises a 24 volt power source and two Darlington transistors $Q_1$, $Q_2$. The two transistors are rendered conductive or non-conductive by the state of the two isolators 164, 166 which in turn depend on the state of the two outputs 126*a*, 126*b* from the controller. Thus, a "high" output on 126*a* turns on transistor $Q_1$ and a "high" signal on output 126*b* turns on transistor $Q_2$.

The motor 120 can be turned on, turned off, or dynamically braked depending on the state of the transistors $Q_1$, $Q_2$. When $Q_1$ conducts and $Q_2$ is non-conducting, the motor 120 is on with a 24 volt signal across its terminals. When $Q_2$ conducts the motor's terminals are short circuited and dynamic braking occurs. When $Q_1$ and $Q_2$ are turned off the motor 120 is off but coasts without dynamic braking.

It is the function of the microprocessor 122 to periodically "read" the inputs 124*a–d*, evaluate the registration situation between the photoreceptor image and the copy sheet and output an appropriate signal on lines 126*a*, 126*b* to first achieve and then maintain a position and speed match between the image and the copy sheet. Two microprocessor scratch pad registers are used to store information relating to both position and speed synchronization between the photoreceptor image and the copy sheet. A first register, DEL represents the position error of the registration drive with respect to the photoreceptor image. This DEL register changes on the receipt of clock pulses from the machine encoder 130 and tach pulses from the transport encoder 134. The microprocessor algorithm is chosen such that a zero value in the DEL register means a position match between the image and copy sheet.

A digital phase detector register (PDR) represents the relative speed between the photoreceptor and the sheet transport. A +1 in this register indicates the transport motor 120 is slower than the motor 24. A 0 in the PDR register indicates the motors 120, 24 are in speed registration and a −1 in that register indicates the motor 120 is faster than the photoreceptor motor 124. The manner of calculating the DEL and PDR values will become clear when a flow chart of a preferred registration scheme is discussed below.

The desired energization of the motor 120 as a function of the contents of the two registers DEL and PDR is given as follows:

TABLE 1

| | PDR | | |
|---|---|---|---|
| DEL | +1 (Slow) | 0 (Match) | −1 (Fast) |
| + . . . Lagging | ON | ON | ON |
| +4 | ON | ON | ON |
| +3 | ON | ON | OFF |
| +2 | ON | ON | OFF |
| +1 | ON | OFF | OFF |
| 0 (Zero) | ON | OFF | BRAKE |
| −1 | ON | OFF | BRAKE |
| −2 | OFF | OFF | BRAKE |
| −3 | OFF | OFF | BRAKE |
| −4 | OFF | OFF | BRAKE |
| − . . . Leading | OFF | OFF | BRAKE |

In general, the finger spacing or pitch can be greater than, equal to, or less than the image spacing. In a multiple pitch copier the spacings are chosen to be equal for one of the image pitches to ease copy sheet registration. For every other image size, however, the controller 122 must generate signals to controllably energize the motor 120 so that the sheet 114 reaches the image 110 in proper registration.

Figure 6:
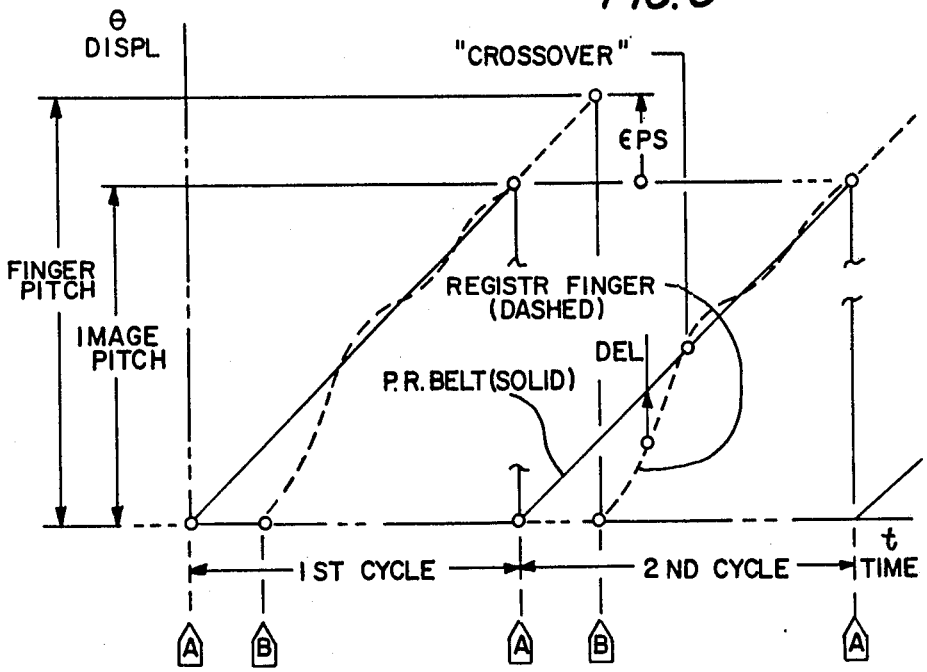
FIGS. 6 and 7 show displacement versus time plots for a photoconductor surface and a registration drive finger as a copy sheet is driven to the transfer station.

FIG. 6 represents a plot of photoreceptor image and registration finger trajectories produced by the above motor energization scheme for a finger pitch greater than the image pitch. The plot is a displacement vs. time graph so that the slope of the plot is the instantaneous velocity of the image (solid line) and registration finger (dotted line). The goal is to achieve a position and speed match and then maintain that match as the image is transferred to the copy sheet.

The images are driven at a constant speed by the motor 24 and therefore the image trajectories appear as solid lines of constant slope (speed). As each new image passes the sensor 132 a mark on the photoreceptor indicates the passage of an image trailing edge and generates an "A" signal that begins a new cycle for the registration technique.

Since the registration finger spacing is greater than the image spacing it is apparent that the copy sheet speed must temporarily be greater than the photoreceptor image speed if the sheet is to "catch up" to the image. This catch up period of increased registration finger speed occurs immediately after the sensor 136 senses the presence of one of the fingers 90, 90′ (Event B). As seen in FIG. 6, the finger speed (dotted line) is greater than the image speed once the registration signal is sensed and remains greater until a first position match is obtained.

A slight overshoot or crossover occurs after the first position match occurs. The controller 122 quickly compensates for this overshoot, however, and precise position and speed registration is achieved until the next B signal from the sensor 136 occurs. Then the registration cycle repeats for each subsequent copy sheet feed to the photoreceptor.

Figure 7:
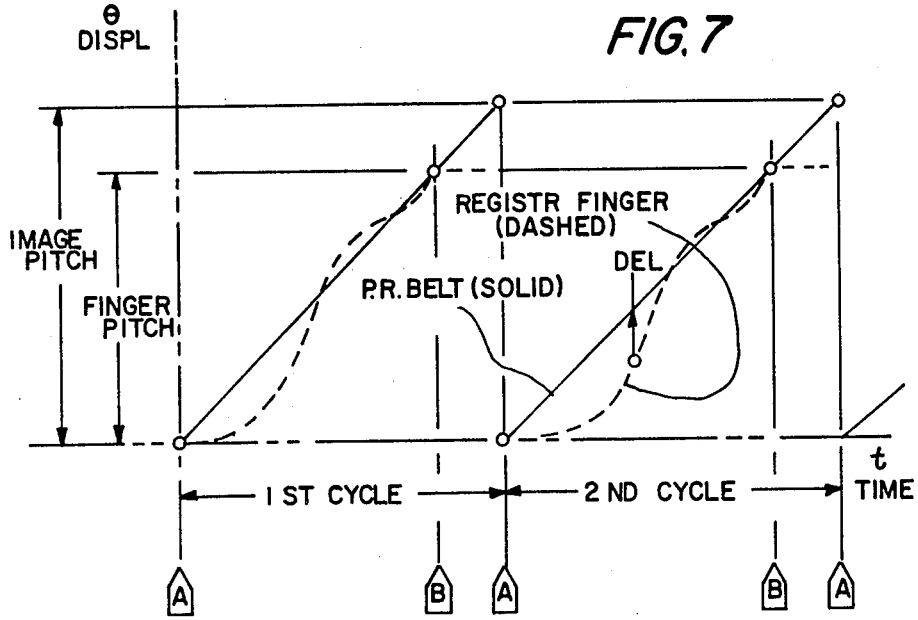

The copy sheet and image trajectories for a finger spacing less than the image spacing are shown in FIG. 7. Here, the registration drive must wait for the image. If the drive motor 120 is not temporarily stopped or slowed for each image, the sheet would lead the image each time a transfer takes place. This delay takes place each time finger 90, 90′ is sensed (Event B, FIG. 7). A brake signal is then applied to the motor 120 until the sensor 132 senses the passage of an image (Event A) and a synchronization between image and registration drive is again initiated and completed before image transfer.

Figure 8:
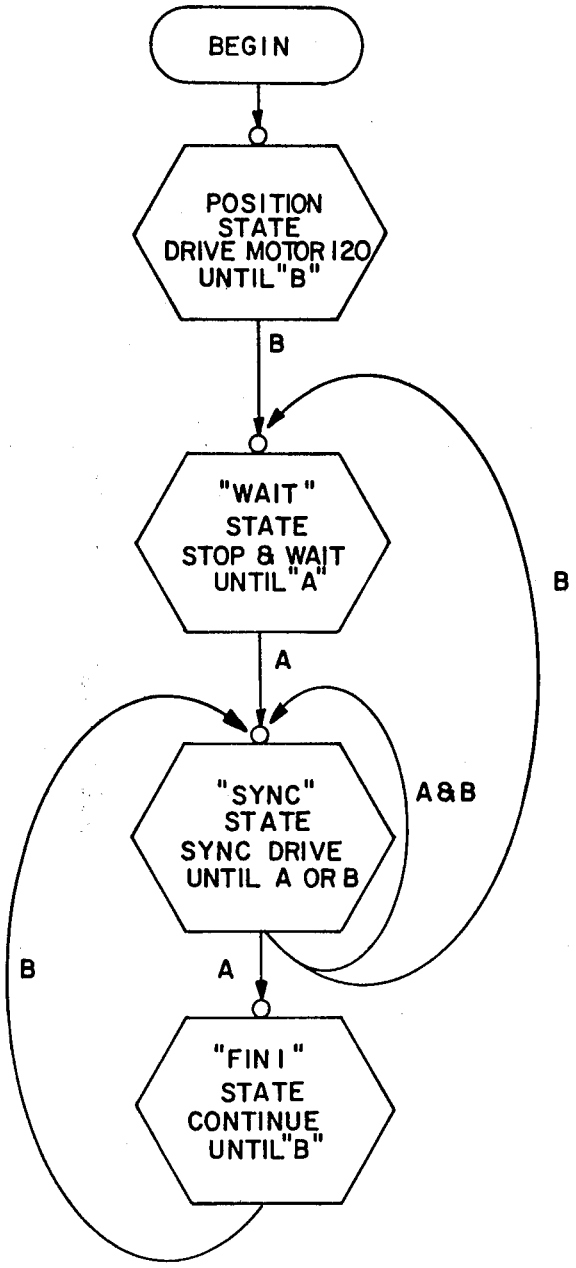
FIGS. 8–11 disclose flow charts for programming the microprocessor to drive copy sheets into position and speed registration with images on the photoconductor at the transfer station.
Figure 9A:
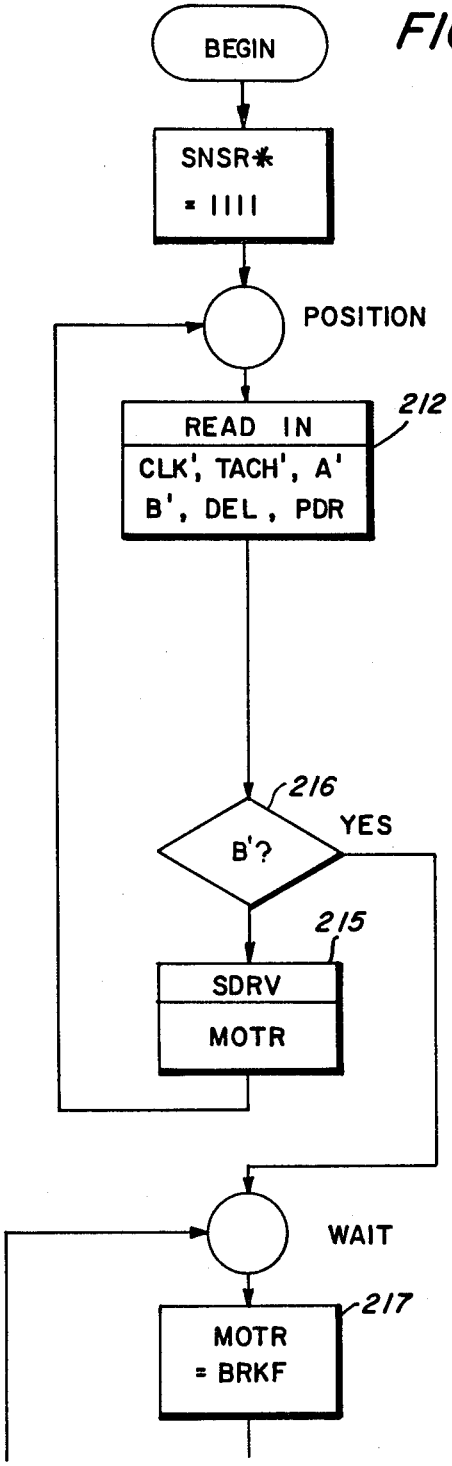
Figure 9B:
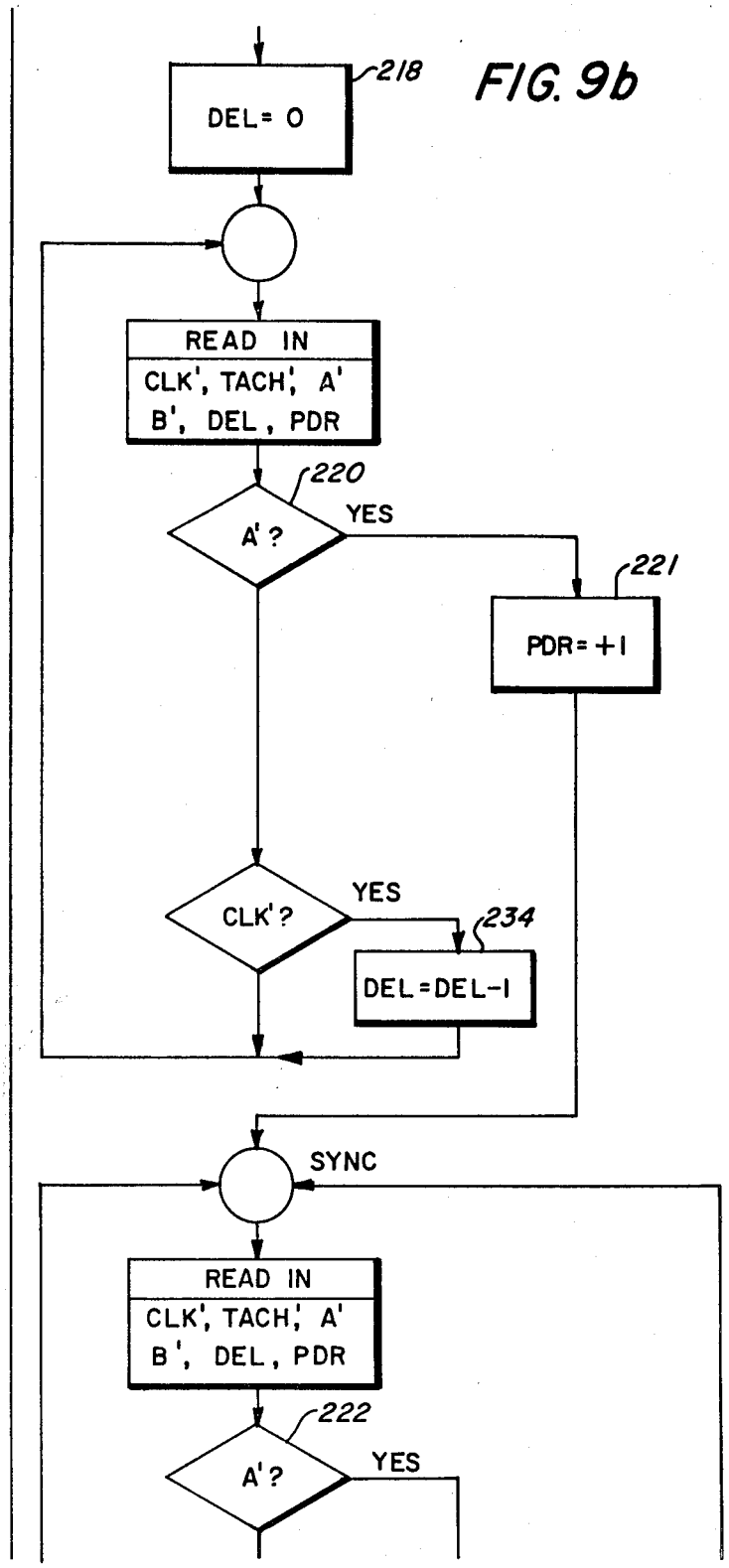
Figure 9C:
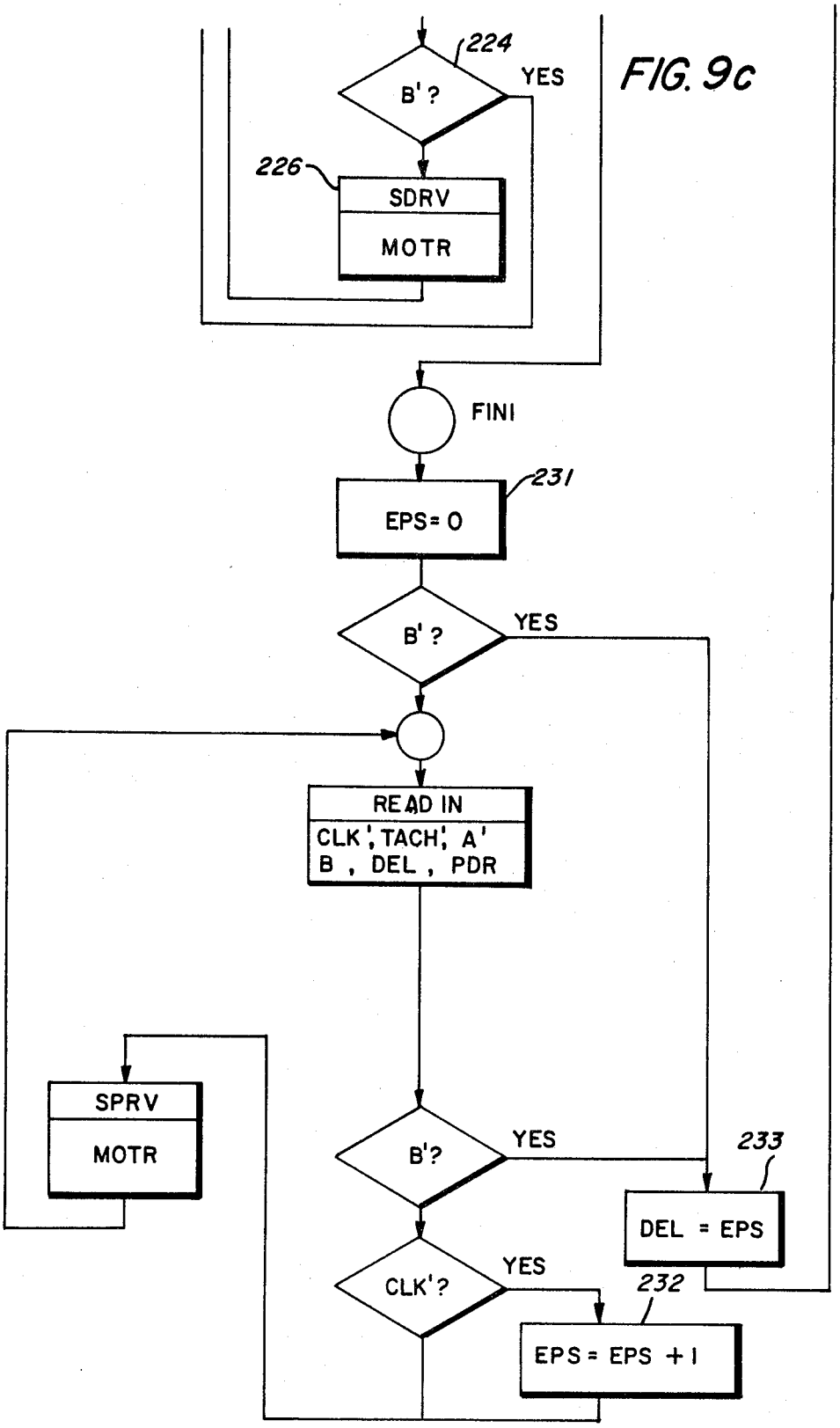

A method for achieving the position and speed match is depicted in the flow chart in FIGS. 9*a*–9*c*. This method functions in all three possible pitch configurations, i.e. the finger spacing is less than, equal to, or greater than the image spacing. A summarization of the method is shown in the FIG. 8 "state" diagram which defines the four possible states the registration control scheme can be in during the copying process.

At system startup the fingers 90, 90′ and photoreceptor occupy no specific relation to each other. In accordance with the state diagram, the transport 42 is driven until a finger 90 or 90′ is sensed (Event B) and then the sheet transport is halted ready to receive a first copy sheet. The controller enters the "wait" state until a first image is transmitted to the photoreceptor and the motor moves the photoreceptor to a position where the sensor 132 sees a mark on the photoreceptor. At this point, the controller 122 enters a so-called "sync" state where the speed and position of the first image and copy sheet are matched. Receipt of the next sensor input, either A or B, causes the controller to leave the "sync" state and either enter a so-called "fini" state or re-enter the wait state depending on whether the finger spacing is less than (wait) or greater than (fini) the image spacing. If the A and B events occur at the same time (or approximately so) the finger spacing equals the image pitch and the controller remains in sync.

Figure 10:
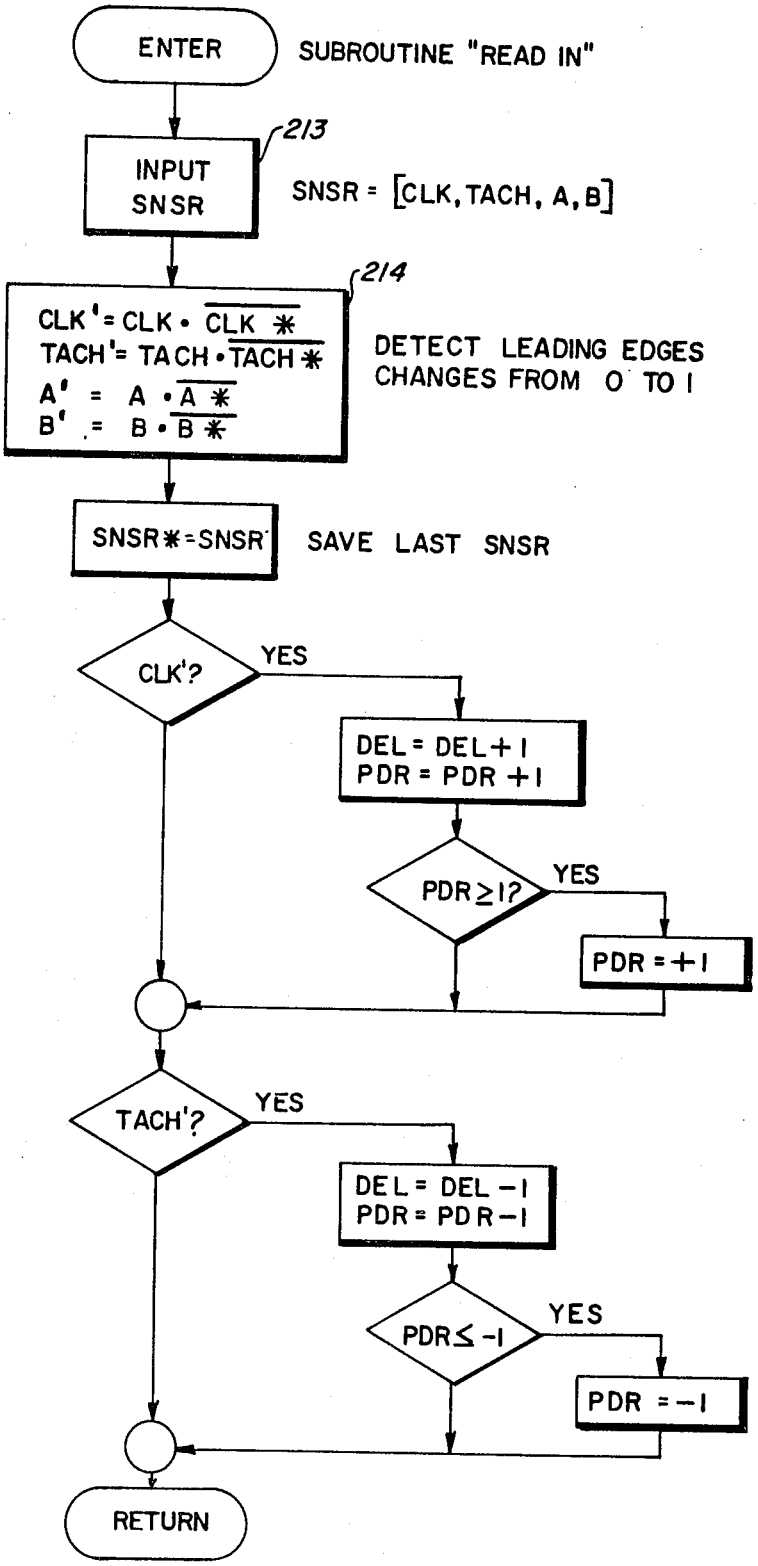
Figure 11:
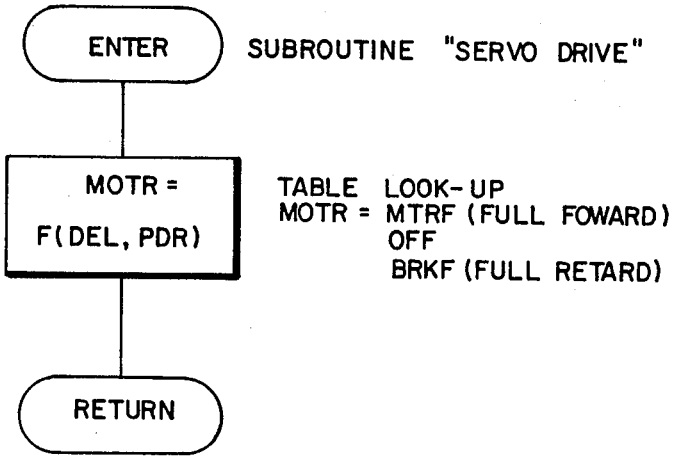

Each of the four state controller conditions will be discussed in relation to the algorithms disclosed in FIGS. *9a–9c*. These algorithms in turn access system subroutines designated "read in" and "servo drive" (FIGS. 10 and 11). As the names suggest, the "read in" routine senses the status of the inputs 124*a–d* and the "servo drive" routine outputs controls to the motor 120 in accordance with the contents of the DEL and PDR registers.

At a first step (FIG. 9*a*) in the algorithm, a four bit register designated SNSR* is initialized to all ones. This register is used in the "read in" routine (FIG. 10). The controller 122 then enters the so-called "position" state which drives the motor 120 until the sensor 136 senses the presence of one of the registration fingers 90, 90' (Event B). At a first step 212 in the "position" routine, the "read in" subroutine is accessed so that the status of the inputs from the four sensors can be read. The "read in" subroutine, FIG. 10, begins with the reading at step 213 of the four signals on input lines 124*a–d* and the storing of this data in a sensor register SNSR. The signals (high or low) are then compared with the complement of the contents of SNSR* at step 214 to determine which of the inputs has changed states since the last time the "read in" routine was accessed. The contents of SNSR* are then replaced by the contents of SNSR in preparation for the next time that the "read in" routine is accessed. The receipt of either a clock or tachometer pulse causes the "read in" subroutine to change the state of both the DEL and PDR registers in a manner illustrated in the "read in" subroutine algorithm. The change in these registers complete the "read in" subroutine and returns operation to the main program. During the position state at step 216, the controller is making a determination if the sensor 136 senses the presence of one of the two registration fingers 90, 90'. If a registration finger is not sensed, the controller drives the motor 120 by accessing the "servo drive" routine at step 215 until an affirmative result is obtained at the decision step 216.

Once a registration finger is sensed during the position algorithm, the controller 122 enters the so-called wait state of its routine. As a first step 217 in the wait state, the motor 120 is issued a brake signal and at step 218 the DEL register is initialized to zero. The "read in" subroutines is then accessed and sensor inputs taken until an indication that the sensor 132 has sensed a mark on the photoreceptor which occurs at step 220. Since the motor 120 cannot in general come to an immediate stop after the brak command at step 217, tach pulses may be sensed and the DEL register decremented correspondingly by the "read in" subroutine during this type. However, any CLK pulses that may be sensed with corresponding incrementing of the DEL register by the "read in" subroutine during this time will be cancelled by decrementing the DEL register at step 234. The result is that when a signal from sensor 132 is received the contents of the DEL register will represent initial misalignment of the registration and photoreceptor positions. At this step 220, the controller 122 sets the PDR register equal to 1 (step 221) and begins the synchronization process. The synchronization state begins with the accessing of the "read in" subroutine and the testing 222, 224 of the photoreceptor and registration sensors respectively. When the "sync" state is first accessed, the registration drive and the photoreceptor are distinctly out of synchronization since the motors 24, 120 have just driven the photoreceptor belt 10 and registration 42 respectively away from the sensor signal transition positions. A negative decision at steps 222, 224 accordingly occurs. Therefore the next step 226 in the synchronization state is to drive the motor according to a "servo drive" subroutine (FIG. 11) which controls the outputs 126*a*, 126*b* to the motor 120 in accordance with a table look-up scheme in conformity with Table I relating motor energization as a function of the DEL and PDR registers. As the synchronization state continues, the algorithm alternately reads in sensor data from the "read in" subroutine and drives the motor using the "servo drive" routine until either a registration finger or photoreceptor mark is sensed. It is assumed that before either event A or B is reached, the "servo drive" routine as exemplified by the look up table energization scheme has produced a speed and position match between copy sheet and image to be transferred from the photoreceptor belt.

The occurrence of either of these events (A or B) causes the controller 122 to exit the synchronization state and enter either the "wait" or "fini" states. The "fini" state is entered when the sensor 132 senses a photoconductive marking prior to the passage of one of the registration fingers 90, 90' in the vicinity of the sensor 136. This happens in those instances when the registration finger spacing or pitch is greater than the photoconductor image pitch and therefore the controller 122 enters a state which causes it to wait for the occurrence of a B signal from the sensor 136. During the "fini" state, the "read in" and "servo drive" subroutines are continually accessed until a B signal from the sensor 136 occurs. Thus, the speed registration between photoreceptor and registration drive is maintained in the "fini" state. It should be recalled, that when the registration drive spacing pitch is greater than the photoreceptor spacing, the recepit of a B signal from the sensor 136 is followed by a catch-up stage in which the motor 120 drives the registration finger at a rate faster than the photoreceptor until position registration is achieved. The "fini" state includes a bookkeeping function at steps 231, 232, 233 which keeps track of the degree of position registration between registration finger and image. As the "fini" state is first entered, a bookkeeping register referred to as an EPS register is initialized at step 231 to zero and incremented (step 232) upon the receipt of each clock pulse between the entering of the "fini" state and exiting of that state once a B signal is received from the sensor 136. Since during the "fini" state the registration fingers and photoreceptor are moving in speed registration with each other, the number of clock pulses occurring before the sensor signal is received is an indication of the difference in spacing between the fingers 90, 90' and the marks about the periphery of the photoreceptor. Therefore, the EPS register is an indication of the amount of position misregistration between the registration fingers and the image. As a result, when the B signal from the sensor 136 is received, DEL is set equal to EPS (step 233) so that the synchronization state is entered with an indication in the DEL register of the misregistration between registration fingers and photoreceptor images. As the motor 120 is driven in the synchronization state, the DEL register is periodically updated during the "read in" subroutine until a position and speed match are achieved through controlled acceleration of the motor 120 in the "servo drive" subroutine (FIG. 11). The synchronization process is repeated for each sheet that is driven to the photoreceptor for image transfer.

In the instance in which the photoreceptor spacing or pitch is greater than the registration drive finger spacing (FIG. 7), the synchronization state will be exited at a step 224 where the sensor 136 senses a registration finger. Under these circumstances the controller 122 enters the "wait" state to proceed as before.

In summary, the controller 122 is programmed according to an algorithm featuring four distinct controller states. The controller 122 enters and exits these four states in response to the sensing of information during the "read in" subroutine. The various algorithm states are additionally used to drive the motor 120 to achieve and maintain position and speed registration dependent upon the states of the DEL and PDR registers according to the strategy outlined in the above table.

The disclosed algorithms can be implemented in machine language code in a variety of ways. The preferred embodiment utilizes non-volatile memory to avoid the necessity of reloading the algorithms into memory each time power is applied to the system. The algorithms disclosed in FIGS. 8–11 are illustrative of a preferred registration scheme but it is believed the invention could be implemented using other motor control formats.

While the present invention has been described in connection with a preferred embodiment thereof, it will be understood that it is not intended to limit the invention to that embodiment. On the contrary, it is intended to cover all alternatives, modifications and equivalents as may be included within the spirit or scope of the invention as defined by the appended claims.

I claim:

1. In a reproduction machine for copying images from a variable pitch moving image source onto a moving copy sheet, apparatus for synchronizing sheet and image registration comprising:

(a) means for moving the sheet into image transfer relationship with the source to transfer an image to said sheet;

(b) means for generating speed signals related to the speed of said source and said copy sheet respectively;

(c) means for monitoring the position registration of said copy sheet with respect to an image on said source; and (d) control means coupled to outputs from said means for generating and said means for monitoring to compare the difference if any between position and speed registration, and further coupled to said means for moving to register the image with the sheet at the point of image transfer.

2. The apparatus of claim 1 wherein the control means comprises:

(a) means for comparing the speed of said sheet with the speed of said image and indicating the difference in said speeds;

(b) means for calculating the difference, if any, in position registration between the sheet and the image; and (c) means responsive to said means for comparing and said means for calculating to determine how the sheet speed should be changed to achieve a match in both speed and position registration before said sheet moves into image transfer relation with said source.

3. The apparatus of claim 1 or 2 wherein the control means comprises storage means for storing updated indications of said position and speed registration as the sheet moves toward the source.

4. In xerographic reproduction imaging, a process for achieving both position and speed registration between a sheet feeder and a variable pitch copier comprising the steps of:

(a) sensing the movement of a sheet toward said copier;

(b) calculating the error, if any, of speed and position registration of said sheet with respect to said variable pitch copier;

(c) varying the speed of movement of said sheet to bring said sheet into registration; and (d) updating the error calculation and continuing to vary the sheet speed until said sheet reaches an image transfer position.

5. In a xerographic reproduction machine having a variable pitch, moving photoconductive member, apparatus for matching both position and speed of a sheet from a feeder mounted to the reproduction machine with the movement of the photoconductive member comprising:

(a) a direct current motor for moving individual sheets along a path in relation to the photoconductive member;

(b) means for sensing the passage of a sheet past a reference point;

(c) control means comprising circuitry coupled to said means for sensing for calculating the error, if any, of the speed and position of said sheet with respect to said variable pitch photoconductive member and for generating control signals to said motor to turn on, off, or brake said motor depending on the result of both initial and updated error calculations, in order to adjust the speed of said sheet to achieve and maintain a position and speed match between the sheet and the photoconductive member.

6. In xerographic copying, a process for moving a copy sheet into a registered image transfer relationship with a moving developed image at a desired speed comprising the steps of:

moving said sheet to a first position, awaiting the passage of said developed image past a sensor position, and driving said sheet away from said first position toward said developed image so that said sheet reaches an image transfer station in both position and speed registration with said developed image, said driving step performed simultaneously with intermittent monitoring of the speed and position co-ordination between sheet and image as the two approach at a transfer station and modification of the movement of said sheet to insure proper registration in the region of image transfer.

7. The process of claim 6 wherein the driving step is performed by controllably braking, accelerating and allowing to coast a direct current motor coupled to means for moving said sheet in relation to an image bearing member.

8. In a xerographic copier, apparatus comprising:

a photoconductive belt member for carrying xerographic images to an image transfer station, said belt member capable of carrying multiple images spaced about its periphery and including spaced markings separated by a distance equal to the image pitch;

copy sheet feeding means mounted to said copier for feeding successive copy sheets to the transfer station to receive xerographic images from the belt member; said sheet feeding means including at least one endless drive belt having one or more fingers for driving sheets along a path of sheet travel;

drive means for moving said drive belt along the path of travel;

means for moving said photoconductive belt member and accompanying images at a constant rate so that said images approach said transfer station at said constant rate, sensing means for monitoring drive belt movement said means for moving and generating a clock signal with a frequency related to the speed of said drive belt;

image sensing means for sensing the movement of said spaced markings past said image sensing means and generating an image signal each time a marking is sensed;

drive sensing means for monitoring the speed with which the drive means moves said drive belt and for generating a speed signal with a frequency related to the speed of said endless drive belt;

sheet sensing means for sensing sheet position and generating a sheet position signal at a specific point of sheet movement in relation to said transfer station; and control means coupled to said copier sensing, image sensing, drive sensing and sheet sensing means to receive sensor input signals and determine whether an image is leading, lagging or registered with an associated copy sheet and for further determining the relative speeds of said image and copy sheet, said control means configured to control operation of said drive means to speed up, brake or maintain the speed with which the drive belt moves to achieve and maintain both a position and speed registration between the image and an associated copy sheet prior to the meeting of said sheet and said image at the transfer station.

9. The apparatus of claim 8 wherein the drive means comprises a direct current motor and further comprises a drive circuit which can be energized to drive said motor, allow said motor to coast, or brake said motor, said control means comprising a programmable controller coupled to said drive circuit for energizing said circuit in response to the sensing of said clock, image, speed, and position signals.

* * * * *